United States Patent [19]

Petrie

[11] Patent Number: 4,535,464

[45] Date of Patent: Aug. 13, 1985

[54] DIGITAL CIRCUITRY FOR PRODUCING INDICATIVE SIGNALS AT PREDETERMINED TIMES PRIOR TO PERIODIC PULSES

[75] Inventor: Adelore F. Petrie, Arlington Hgts., Ill.

[73] Assignee: Motorola, Inc., Schaumburg, Ill.

[21] Appl. No.: 317,710

[22] Filed: Nov. 2, 1981

Related U.S. Application Data

[62] Division of Ser. No. 49,014, Jun. 15, 1979.

[51] Int. Cl.[3] ..... G06M 3/02

[52] U.S. Cl. ..... 377/39

[58] Field of Search ..... 377/39; 123/609, 416, 123/418

[56] References Cited

U.S. PATENT DOCUMENTS 4,008,698 2/1977 Gartner ..... 123/611

*Primary Examiner*—John S. Heyman
*Assistant Examiner*—K. Ohralik
*Attorney, Agent, or Firm*—James W. Gillman; John H. Moore; Phillip H. Melamed

[57] ABSTRACT

Digital circuitry adaptable for controlling dwell in a spark and dwell ignition control system is disclosed. Maximum advance and reference sensors are utilized to produce pulse transitions which determine positions of maximum and minimum possible advance for spark ignition with respect to the position of the engine crankshaft. For each maximum advance sensor pulse transition a main counter starts a sequential running count of speed independent clock pulses wherein the maximum count obtained by the counter is related to engine crankshaft speed. The running and maximum counts of the main counter are utilized by dwell circuitry to determine the time prior to the next maximum advance pulse at which spark coil excitation should occur.

7 Claims, 7 Drawing Figures

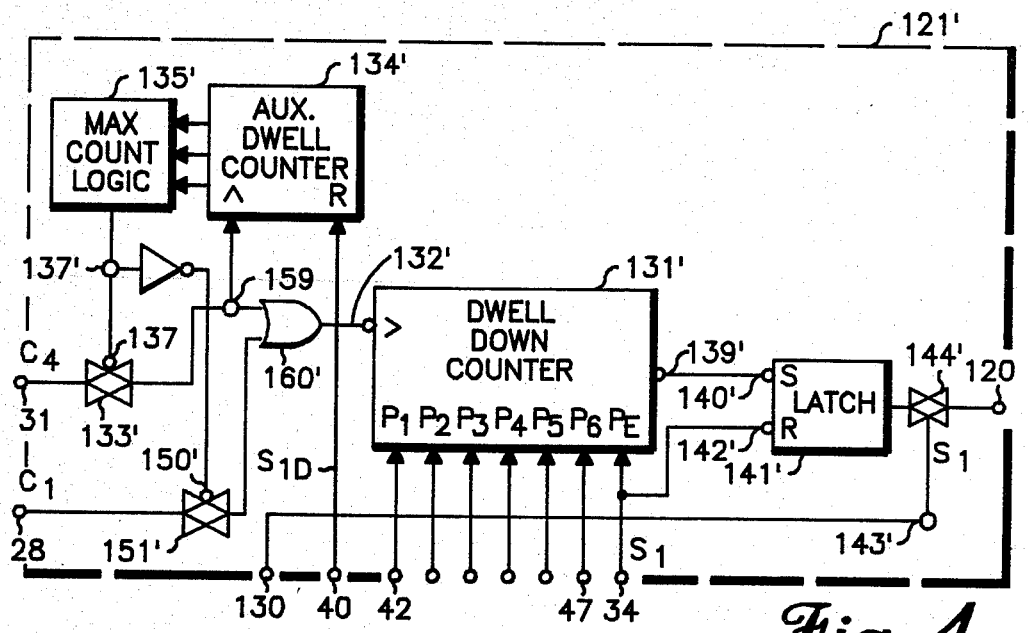
Fig. 4
Fig. 5
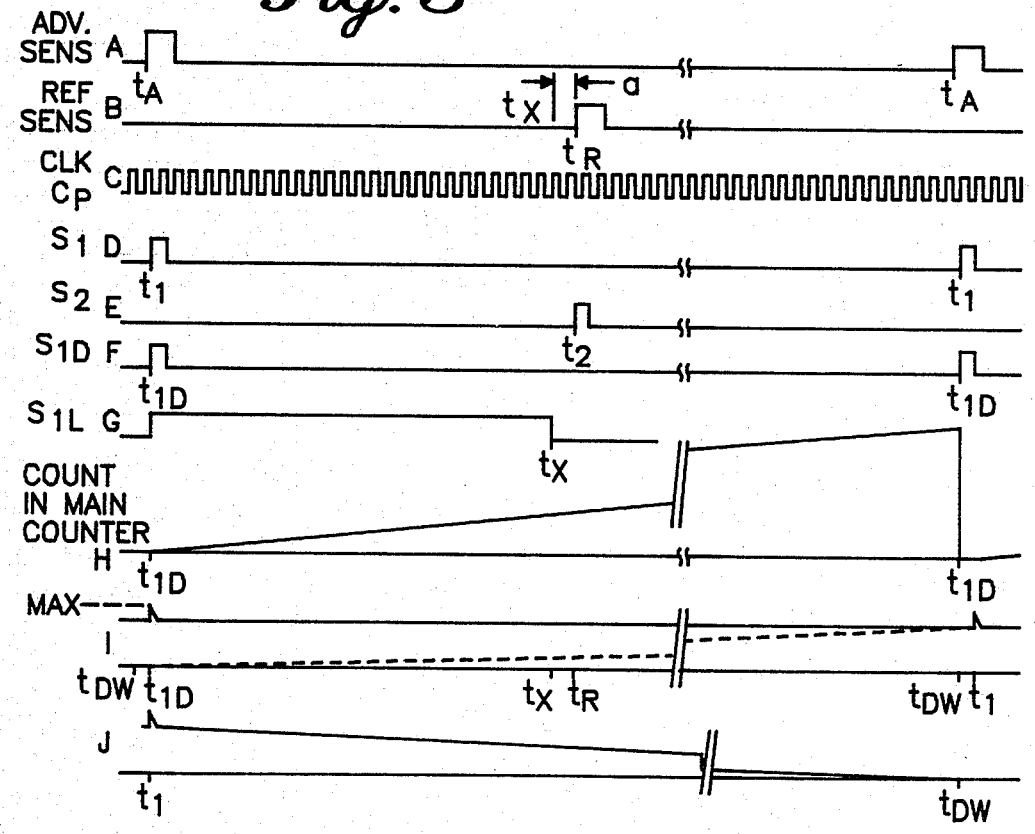

DIGITAL CIRCUITRY FOR PRODUCING INDICATIVE SIGNALS AT PREDETERMINED TIMES PRIOR TO PERIODIC PULSES

This is a division of application Ser. No. 049,014, filed 6/15/79.

CROSS REFERENCE TO RELATED APPLICATIONS

The present invention is related to the inventions described and claimed in copending U.S. patent application Ser. No. 049,016, filed June 15, 1979 entitled "Spark and Dwell Ignition Control System Using Digital Circuitry" by Robert S. Wrathall, now U.S. Pat. No. 4,231,332 and described and claimed in copending U.S. patent application Ser. No. 049,013, filed June 15, 1979 now U.S. Pat. No. 4,329,959 entitled "Dwell Circuitry for an Ignition Control System" by Rupin Javeri, now U.S. Pat. No. 4,300,518. Both of the copending U.S. applications referred to above are assigned to the same assignee as the present invention.

BACKGROUND OF THE INVENTION

The present invention relates generally to the field of digital signal processing circuitry, and more particularly to the field of digital electronic dwell circuits used in ignition control systems which control spark and dwell occurrence.

In internal combustion engines the time occurrence at which a spark is produced to ignite a fuel and air mixture in a cylinder is a primary operational consideration. Similarly, producing an appropriate excitation signal (dwell) for an ignition coil immediately prior to the coil producing spark ignition is also a major design consideration. Mechanical spark control ignition systems have been found not to be reliable over long periods of time thus necessitating frequent readjustment of the mechanical controls. Thus electronic dwell and spark control ignition systems having greater reliability have been developed.

Generally, prior art dwell circuits such as U.S. Pat. No. 4,018,202 utilize a complex and costly cam structure having an extremely large number of individual teeth projections in order to produce a series of high resolution crankshaft position pulses, typically one pulse being produced for every one degree of crankshaft rotation. The construction of these cams is costly and their utilization would tend to inhibit utilization of the same cam to produce other crankshaft position pulses which would occur at other than one degree increments of crankshaft rotation. Of course this deficiency can be overcome by utilizing additional cams and additional crankshaft position sensors, but then the cost of the ignition control system would be increased. While the one degree pulses can be electronically realized by dividing up large angular crankshaft pulses, this would also add to the cost of an ignition control system.

The one degree crankshaft position pulses produced by the prior art dwell circuits represent speed dependent crankshaft position pulses and enable the prior art circuits to readily calculate ignition dwell as a fixed number of degrees of crankshaft rotation. However these circuits have problems in realizing a constant dwell time, rather than constant dwell angle, which is desired for some engine operative conditions. Also prior dwell circuits such as U.S. Pat. No. 4,018,202 require complex feedback circuits having marginal stability.

Some dwell circuits such as those in U.S. Pat. No. 3,908,616 utilize speed independent pulses in order to calculate ignition dwell. While these circuits have eliminated the need for a multi-tooth crankshaft cam or its electronic equivalent for producing high resolution crankshaft position pulses, the disclosed circuit designs cannot produce large dwell angles which are required at high engine speeds. In addition, the dwell circuit in U.S. Pat. No. 3,908,616 contemplates adjusting count thresholds in order to adjust the dwell occurrence and/or contemplates adjusting the rate at which pulse counting takes place. In order to implement either of these two functions, relatively complex and costly control structures are required.

Typically, digital signal processing circuits which intend to implement the function of producing a pulse occurrence a predetermined time prior to the known occurrence of periodic signal pulse transitions having a variable occurrence rate have utilized circuit configurations corresponding to those shown in U.S. Pat. Nos. 3,908,616 or 4,018,202. Therefore they have suffered from the same deficiencies described above.

While the copending U.S. patent application "Dwell Circuitry For An Ignition Control System" provides for overcoming the deficiencies of the prior art, the present invention represents a cost effective improvement which accomplishes the same end result.

SUMMARY OF THE INVENTION

An object of the present invention is to provide an improved and simplified digital signal processing circuit which overcomes the aforementioned deficiencies and initiates a signal at a predetermined time prior to the occurrence of periodic variable rate signal transitions.

In one embodiment of the present invention, improved digital circuitry for receiving a signal comprising periodic pulse transitions and producing indicative signals commencing at predetermined times prior to the occurrence of the periodic pulse transitions is provided. The circuitry comprises: means for producing a periodic signal comprising periodic signal pulse transitions occurring at a predetermined variable rate; means for receiving said periodic signal and for periodically developing a running count by counting pulses occurring at a predetermined rate, independent of said variable rate, between first and second predetermined time occurrences directly corresponding to the occurrence of sequential first and second pulse transitions of said periodic signal, and for providing at said second time occurrences maximum running counts related to the time duration between said first and second pulse transitions; means for periodically receiving said maximum counts and effectively subtracting a predetermined number of counts therefrom to obtain a resultant subtracted count, said subtraction being completed at substantially said second time occurrences; wherein the improvement comprises means counting down from said resultant subtracted count at a rate which is independent of said variable rate; and means for periodically initiating an indicative signal when the down count from said resultant substracted count equals a predetermined threshold count subsequent to said second time occurrence and at a predetermined time prior to the next of said periodic signal pulse transitions.

Essentially an improved digital circuit utilizes crankshaft position sensor means to create said periodic signal ($S_1$) having periodic pulse transitions. This corresponds to the periodic signal producing means providing signal transitions occurring at a variable (engine speed determined) rate. It should be noted that while the present specific embodiment illustrates utilizing crankshaft position sensor pulses directly as the periodic signal pulse transitions, the present invention also contemplates utilizing another signal (SSp) as the periodic signal having periodic signal pulse transitions which occur at a predetermined variable rate. A counter means essentially receives the periodic signal and at a first predetermined time occurrence ($t_1D$) directly related to a first pulse transition, the counter commences counting signal pulses ($C_1$) which occur at a speed independent rate. At second subsequent predetermined time occurrences ($t_1$) directly related to a second subsequent pulse transition a maximum running count is obtained which is related to the time duration that exists between the first and second pulse transitions. A subtraction means then effectively subtracts a predetermined number of pulses from this maximum pulse count, wherein the subtraction is essentially instaneously accomplished at the second time occurrences. This subtracted count is then utilized to initiate a signal at a predetermined time prior to the next pulse transition of said periodic signal which occurs after the transitions directly related second time occurrences $t_1$.

The present invention contemplates utilizing a down counter to accomplish the subtraction, and the same down counter receives the next subsequently created running count such that when a zero count is obtained a signal is produced at the counter overflow terminal an indicative signal will be initiated at a predetermined number of counts prior to the occurrence of the maximum running count. It is contemplated that preferably the first and second pulse transitions all have the same polarity. The present invention also readily enables initiating said indicative signals at a fixed speed independent time prior to the pulse transitions of the periodic signal, since the initiation of said indicative signals will occur at a time prior to a pulse transition equal to a predetermined number of the counts of the speed independent signal $C_1$. This is all accomplished without adjusting the rate at which pulse counting occurs and without adjusting the switching threshold of count comparator devices, since in the present invention the count comparator will have a fixed switching threshold corresponding to when the subtracted count precisely equals zero.

BRIEF DESCRIPTION OF THE DRAWINGS

For a more complete understanding of the invention, reference should be made to the drawings, in which:

FIG. 4 is a schematic diagram of a preferred typical embodiment for a dwell circuit shown in FIG. 1; and FIGS. 5A through 5J are a series of graphs which illustrate electrical signals and pulse count accumulations as functions of time for the system shown in FIG. 1.

DESCRIPTION OF THE PREFERRED EMBODIMENTS

Figure 1A:
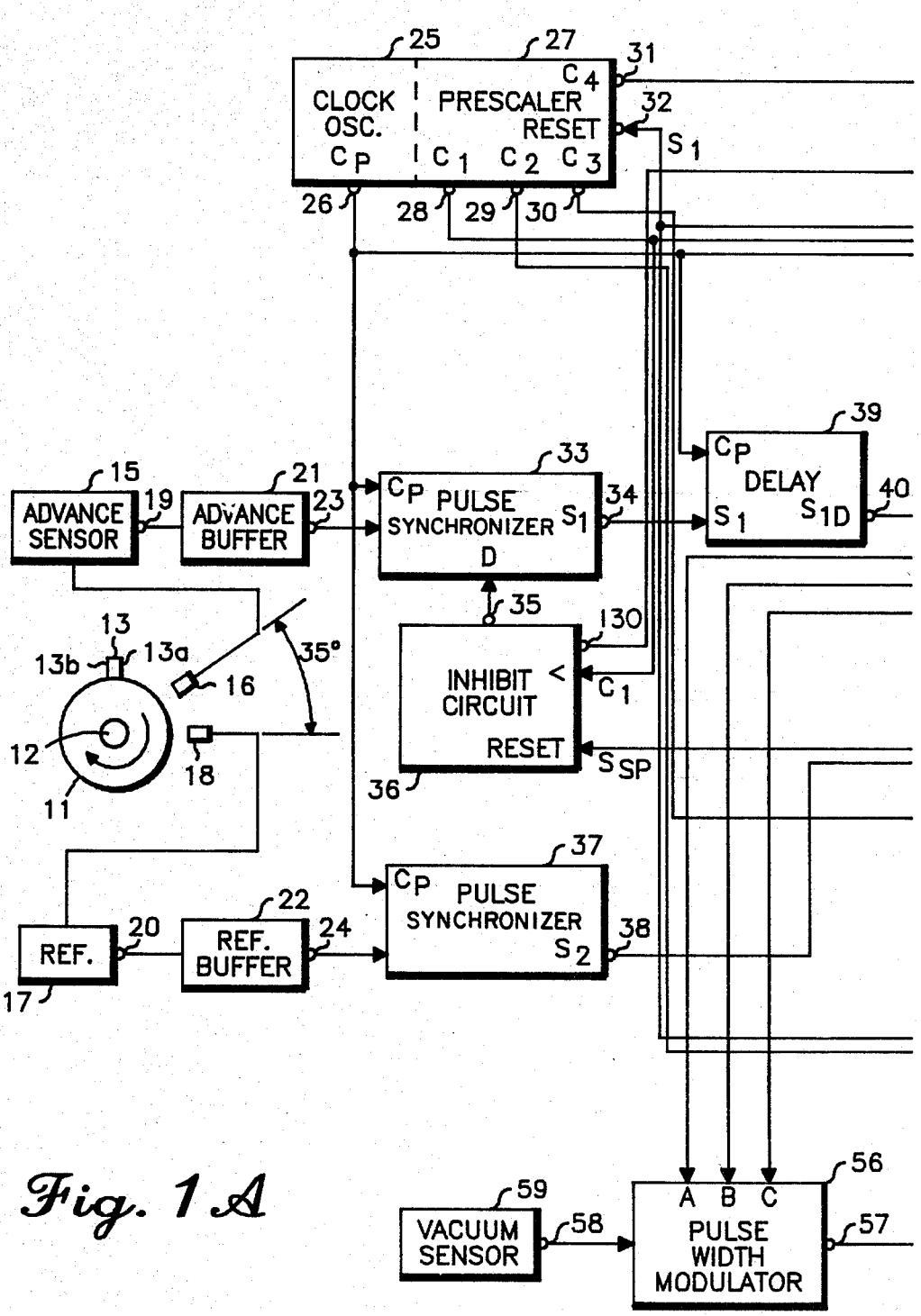
FIG. 1, comprising drawings 1A, 1B and 1C, is a combination block and schematic diagram illustrating an engine ignition control system for an internal combustion engine.
Figure 1B:
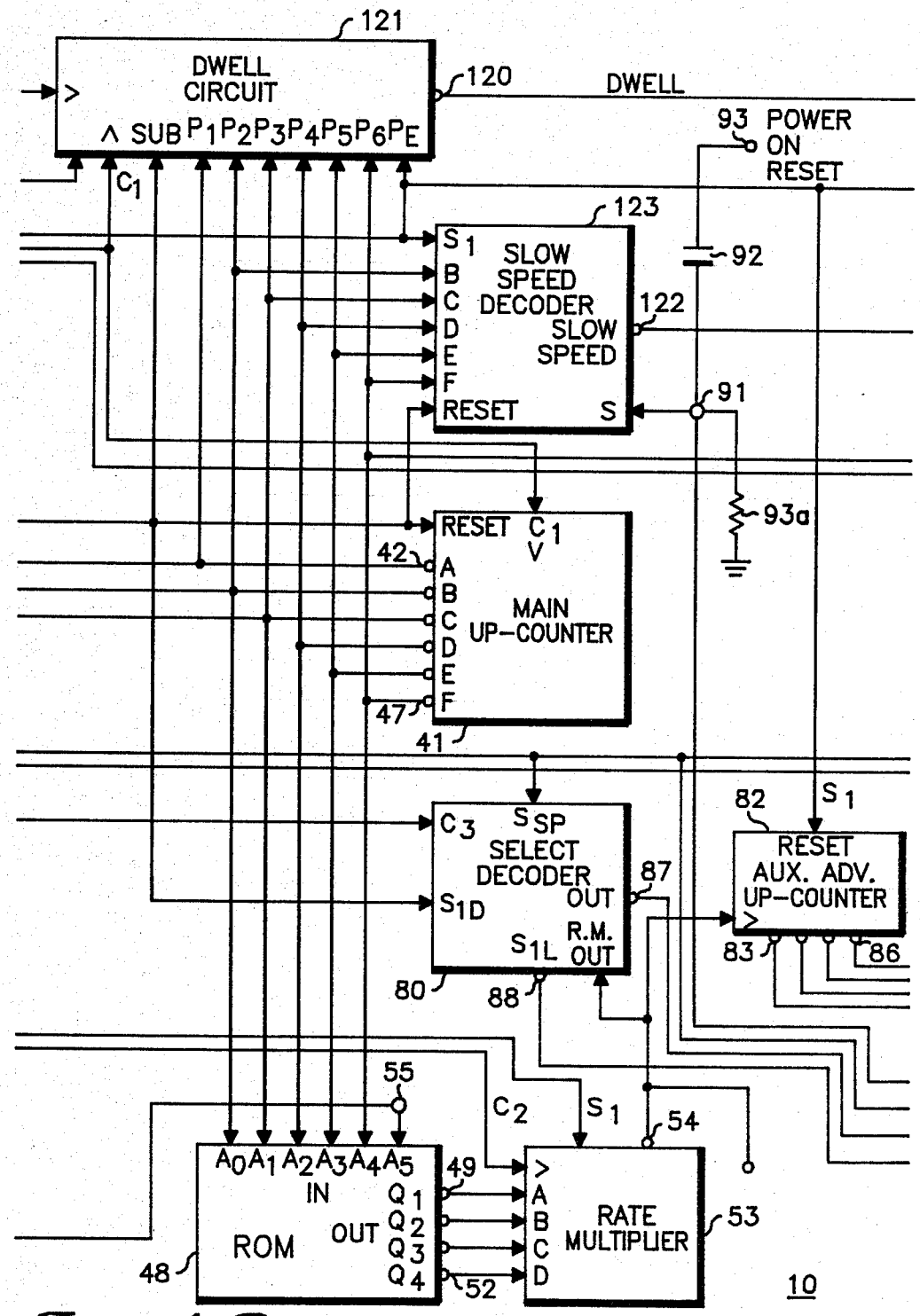
Figure 1C:
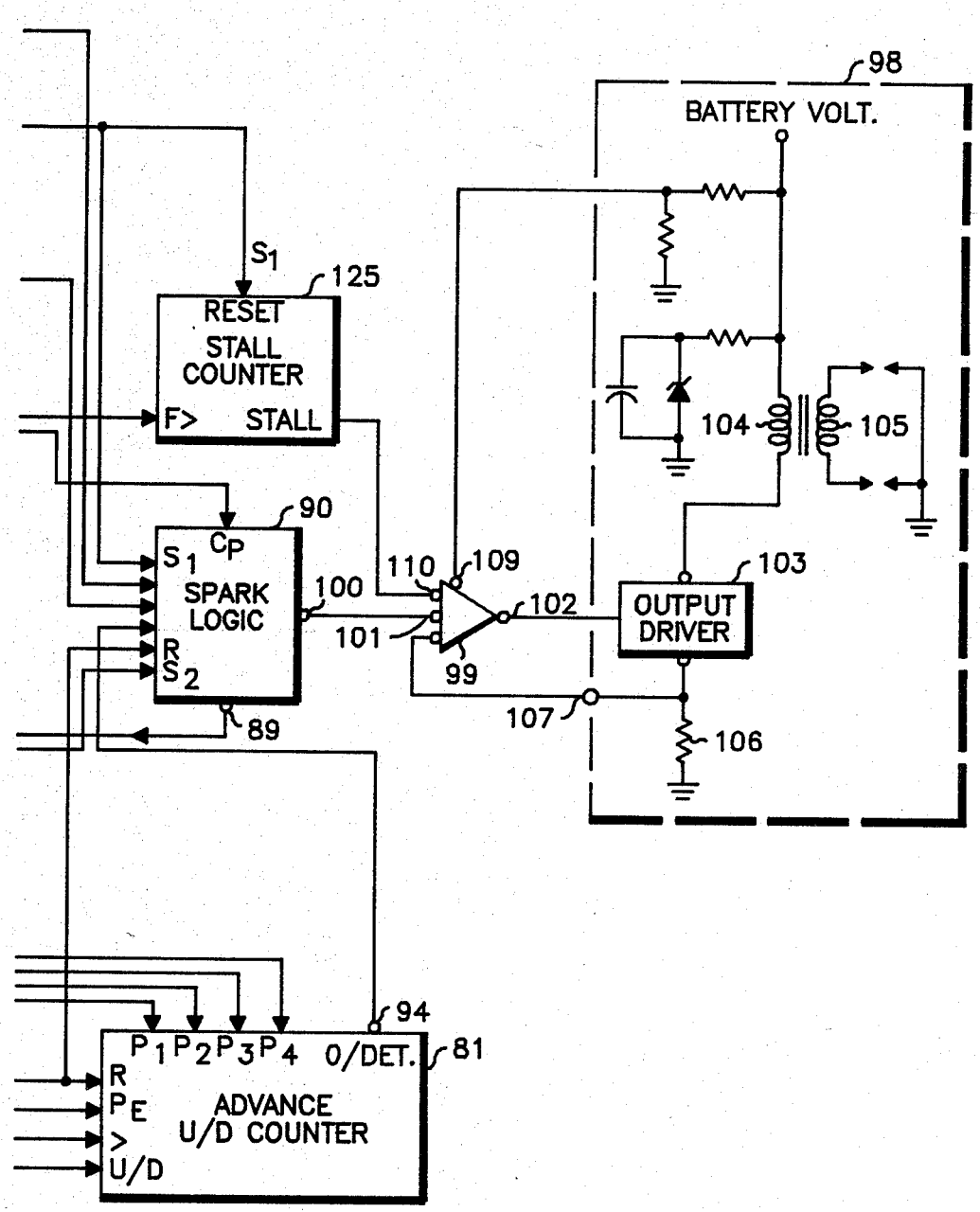

FIG. 1 illustrates an electronic ignition control system 10 for a two cylinder internal combustion engine (not shown). Essentially the control system 10 receives sensor input signals and develops control signals that determine the spark timing and dwell (coil excitation time) for a distributorless inductive ignition system. The term "distributorless" contemplates the fact that no rotating mechanical distributor will be utilized, and that instead sparks will be created in each of the two cylinders simultaneously but at different times with respect to the compression cycle of each cylinder. In other words, when a spark is generated for cylinder 1 at the proper time of its compression cycle, a spark will also be generated in cylinder 2 but this spark will occur during the exhaust cycle of cylinder two and therefore will not result in igniting a fuel mixture. Distributorless ignition systems are known and do not form an essential part of the present invention.

The control system 10 illustrated in FIG. 1 will now be described. For a better understanding of FIG. 1, drawings 1A, 1B and 1C should be arranged with drawing 1B located between drawings 1A and 1C.

The control system 10 includes a rotating cam 11 synchronously rotatable with a crankshaft of a two cylinder engine, the crankshaft being shown schematically as an axis of rotation 12. The cam 11 has a peripheral projection 13 spaced from the axis 12 and the cam 11 is contemplated as rotating in a clockwise direction.

An advance sensor 15 is contemplated as having a sensing probe 16 positioned at a fixed location with respect to the rotating cam 11, and a reference sensor 17 is contemplated as having a sensing probe 18 similarly positioned with the probes 16 and 18 being spaced apart by 35 degrees of angular rotation of the cam 11 (which corresponds to 35 degrees of engine crankshaft rotation). The probes 16 and 18 produce crankshaft angular position pulses as the projection 13 rotates by these probes with the produced position sensing pulses initially occurring in response to the passage of a leading edge **13*a* of the projection passing by the sensing probes and the position pulses terminating after a trailing edge 13*b* has passed by the probes 16 and 18. The sensors 15 and 17 receive input signals from their corresponding sensing probes and produce digital pulse outputs in correspondence thereto at output terminals 19 and 20**, respectively.

It should be noted that the positioning of the sensing probes 16 and 18 with respect to the rotating cam 11 and its projection 13 is not totally arbitrary and that it is contemplated that the probe 16 is positioned such that it defines the maximum possible advance (earliest possible spark ignition occurrence for a cylinder compression cycle) for the ignition system 10 while the probe 18 defines the minimum possible advance (generally corresponding to top dead center of cylinder position which is generally termed zero or reference advance). Thus the positioning of the probe 16 and 18 define the earliest and latest possible occurrences of spark ignition, respectively, for the ignition control system 10. The significance of this will be demonstrated subsequently.

The advance and reference output terminals 19 and 20 are coupled as inputs to advance and reference buffers 21 and 22, respectively, which impedance isolate the sensors from subsequent circuitry and insure the production of precise, uniform magnitude corresponding digital pulses at output terminals 23 and 24, respectively. FIGS. 10A and 10B illustrate the sensing pulses produced at the terminals 23 and 24, respectively, and illustrate that these pulses occur periodically at times $t_A$ and $t_R$ corresponding to the passage of the leading edge 13*a* past the sensing probes 16 and 18. The time occurrences $t_A$ and $t_R$ of the pulses at the terminals 23 and 24 are utilized by the ignition control system 10 to determine spark timing and dwell, and the manner in which this is accomplished will now be discussed with reference to the circuit schematics in FIGS. 1 through 4 and the graphs in FIGS. 5A–J. It should be noted the horizontal axis in FIGS. 5A–J is time and that all graphs in FIG. 5 are drawn having the same time axis scale, except FIG. 5C which is drawn with a greatly expanded time scale.

The control system 10 includes a master clock oscillator 25 which produces clock timing pulses $C_P$ at an output terminal 26 wherein the frequency of the clock oscillator is preferably 149.25 KHz. The clock pulses $C_P$ are illustrated schematically in FIG. 5C on a greatly expanded horizontal time scale and are continuously produced by the oscillator 25 regardless of the angular position of the crankshaft of the engine. A prescaler 27 is shown as being integral with the clock oscillator 25 and producing output signals C1 through C4 at output terminals 28 through 31, respectively. The prescaler essentially comprises a series of counters which receive the clock signal $C_P$ and produce related lower frequency signals by essentially counting and thereby frequency dividing down the oscillator signal pulses $C_P$. Such prescalers are very well known and thus the construction details of the prescaler 27 will not be discussed. The C1 signal produced at the terminal 28 has an operative frequency of 1.16 KHz, C2 has a frequency of 9.33 KHz, the frequency for C3 is 49.75 KHz and the frequency of C4 is 74.6 KHz. All of the signals $C_P$ and $C_1$–$C_4$ have repetition rates independent of the speed of crankshaft rotation. The prescaler 27 hs a reset terminal 32 which causes resetting of the counters internal to the prescaler 27. The signals developed by the clock oscillator 25 and prescaler 27 at the terminals 26 and 28 through 31 essentially determine the operation of the ignition control system 10 in conjunction with the pulses sensed by the advance and reference probes 16 and 18. The signals produced at the terminals 28 through 31 are essentially used in various counters included in the ignition control system 10 and therefore the provision for resetting the internal counters in the prescaler 27 via the reset terminal 32 is required to insure that counters receiving their inputs in accordance with the signals at the terminals 28 through 31 will by synchronized with the advance sensor signal $S_1$ described below.

A pulse synchronizer 33 receives an advance signal input from the terminal 23 and the clock pulse signal $C_P$ from the terminal 26. The pulse synchronizer produces a synchronized advance pulse $S_1$ at an output terminal 34. Essentially, the synchronizer 33 insures that a pulse $S_1$ is produced at the terminal 34 at a time $t_1$ which corresponds to the first clock pulse $C_P$ that occurs after the time $t_A$. In this manner the signal $S_1$ (shown in FIG. 5D) represents an advance pulse which is synchronized with the occurrence of the clock pulses $C_P$.

The pulse synchronizer 33 also receives an input at a terminal D from an output terminal 35 of an inhibit circuit 36. Essentially the inhibit circuit 36 produces a 4 millisecond delay pulse at the terminal 35 in response to the occurrence of spark ignition and this delay or inhibit signal at the terminal 35 prevents the pulse synchronizer from producing an output at the terminal 34 for 4 milliseconds after the occurrence of spark ignition. The reason for this is to quiet the output of the synchronizer 33 such that additional sparks will not be initiated by the synchronizer 33 until at least 4 milliseconds has elapsed since the last spark occurrence.

A pulse synchronizer 37 is similar to the synchronizer 33 and receives inputs from the reference sensor terminal 24 and the clock pulse terminal 26 and produces a synchronized reference pulse signal $S_2$ at an output terminal 38. The synchronizer 37 merely insures that a reference signal $S_2$ has an initial time occurrence which precisely corresponds to the occurrence of one of the clock pulses $C_P$. Since it is contemplated that the frequency of occurrence of the clock pulse $C_P$ is very high (higher than all other timing signals C1–C4), this synchronization results in substantially no loss in accuracy for the present system, due to delaying advance and reference timing by one clock pulse, but does insure that the reference pulse $S_2$, as well as the advance pulse $S_1$, will occur in synchronism with the clock pulse $C_P$. This insures synchronized timing for the control system 10. The reference signal $S_2$ is illustrated in FIG. 5E as comprising periodic pulses which occur at the times $t_2$. It should be remembered that the duration of time between the occurrence of the advance pulses $S_1$ at $t_1$ and the reference pulses $S_2$ at the time $t_2$ corresponds to 35 degrees of engine crankshaft rotation. Of course the actual time duration between $t_1$ and $t_2$ will vary directly as a function of engine speed.

A delay circuit 39 receives the signal $S_1$ along with the clock pulses CP and produces a delayed output signal $S_1D$ at an output terminal 40. Essentially, the delay circuit 39 receives the synchronized signal $S_1$, delays this signal by one full period of the clock pulse signal $C_P$ and produces this delayed signal $S_1D$ at the terminal 40. FIG. 5F illustrates this delay advance signal $S_1D$ which has a time occurrence at $t_1D$ that is one clock pulse period later than the time occurrence $t_1$. The reason for creating the delayed advance signal $S_1D$ is that in many cases the control system 10 will transfer accumulated counts at the times $t_1$ in response to the pulses $S_1$, and subsequently the accumulated counts are to be reset. Obviously the transference and resetting cannot occur simultaneously, thus the present system provides for delaying the resetting until after transference.

The ignition control system 10 essentially utilizes a main up-counter 41 to linearly count up C1 pulses occurring at the terminal 28 in between the occurrence of delayed advance signal pulses $S_1D$. This is accomplished by having the main up-counter 41 receive its counter input from the terminal 28 while its reset terminal is directly connected to the terminal 40. The counter 41 therefore periodically linearly accumulates a speed independent running count which has a maximum value directly related to engine speed since the counting occurs between the times $t_1D$ which occur every 360 degrees of crankshaft rotation.

FIG. 5H illustrates a waveform representative of the linearly incremented running count of the counter 41. It should be noted that individual counting steps have not been illustrated in FIG. 5H since these steps occur at the relatively high frequency of the signal $C_1$ produced by the prescaler 27. In the main counter 41 on a very expanded horizontal time scale, and this figure clearly illustrates the incremental nature of the accumulated count in the counter 41.

The accumulated count of counter 41 is produced at 6 output terminals 42 through 47 with terminal 42 corresponding to the least significant bit and terminal 47 corresponding to the most significant bit. Thus the main up-counter 41 represents a 6 bit binary counter. Such counters are well known and readily available. It should be noted that while the electronic ignition control system 10 utilizes the maximum accumulated count obtained by the counter 41 as an indication of engine speed, the ignition system 10 also utilizes each incremental count produced by the counter 41 at its output terminals 43 through 47 as control signal inputs to spark time occurrence circuitry within the system 10, and these incremental counts are utilized to produce a desired non-linear spark occurrence versus engine speed characteristic. The manner in which this is accomplished is discussed in substantially more detail in issued U.S. Pat. No. 4,300,518, which the present invention is a division thereof. Thus many system details will not be discussed herein since they are already discussed in detail in U.S. Pat. No. 4,300,518, the specification of which is hereby incorporated by reference thereto.

Essentially a ROM 48 functions as a table look-up device which produces different control signals at the terminals 49 through 52 that control the frequency multiplication (division) provided by the rate multiplier 53. The end result is that the output pulse count produced at the terminal 54 is a non-linear function of engine speed such that a desired spark ignition occurrence versus engine speed characteristic can be obtained. An accumulator means effectively integrates or accumulates the pulse count at the terminal 54 and determines, between $S_1$ pulses, a maximum pulse count non-linearly related to engine speed. The magnitude of sensed engine vacuum is also used to determine the maximum pulse count. This maximum pulse count is then utilized to determine spark ignition at times $t_x$.

A select decoder 80 receives an input signal termed SSp from a spark logic circuit 90. The signal SSp is a signal produced by the spark logic circuit 90 at the desired time occurrence $t_x$ of spark ignition and this signal is very short in duration (one period of the high frequency clock pulse signal $C_P$). It is sufficient to note that the signal SSp occurs at times $t_x$ which represent the times at which spark ignition will occur according to the ignition control system 10. A latched signal $S_1L$ (FIG. 5G) is provided between the times $t_1D$ and $t_x$.

The decoder 80 and counters 81 and 82 effectively form an accumulating means for the pulses produced at the output terminal 54 of the rate multiplier 53. At the times $t_1D$, this accumulated count is then linearly decreased at a fixed rate determined by the time occurrence of the pulses $C_3$ until a zero detect signal is produced at the terminal 94. This zero detect signal represents the desired spark timing occurrence, and the spark logic circuit 90 utilizes this signal to produce the signal SSp at the terminal 89 as well as produce a composite signal (dwell/spark) at an output terminal 100 which contains both dwell and spark timing information. This composite signal at the terminal 100 is then coupled to an input terminal 101 of an output predriver 99 which supplies an output at a terminal 102 to a final driver stage 103, in an ignition coil power stage 98 (shown dashed), that controls the excitation of the primary winding 104 of an ignition coil. A high voltage secondary winding 105 of the ignition coil is coupled to the spark gaps of a two cylinder engine to produce ignition pulses therein.

The spark logic circuit 90 which creates the dwell/spark control signal at terminal 100 receives the master clock pulses $C_P$ from a direct connection to the terminal 26. The circuit 90 also is directly connected to the terminals 34 and 38 for receiving the signals $S_1$ and $S_2$, respectively. The spark logic circuit 90 receives the POR signal at a reset terminal for initiating the logic components contained in the circuit 90 in response to the initial application of power to the electronic ignition control system 10. The circuit 90 also receives the zero detect signal produced at the terminal 94 of the main advance counter 81. In addition, the spark logic 90 also receives a dwell initiation signal by means of a direct connection to an output terminal 120 of a dwell circuit 121, and the circuit 90 also receives a slow speed detect signal from an output terminal 122 of a slow speed decoder 123. In response to all of these inputs the spark logic circuit 90 produces the signal SSp at the terminal 89 wherein the SSp signal is a pulse at $t_x$ which exists for one clock pulse period of the pulses $C_P$. The circuit 90 will also create a combined dwell initiate and spark timing occurrence output signal at the output terminal 100.

Essentially, once the spark logic circuit 90 has been reset by the application of power to the electronic ignition control system 10 by the POR signal, the logic circuit 90 will receive dwell initiate signals from the terminal 120 and spark timing occurrence signals from the terminal 94 for each cycle of cylinder compression. If for some reason a dwell initiating signal has not been received by the spark logic circuit 90 prior to the occurrence of the pulse $S_1$ which is generated at the maximum possible advance point of crankshaft rotation, then the spark logic circuit 90 will initiate dwell at the times $t_1$ corresponding to the occurrence of the pulses $S_1$. Similarly, if for some reason a spark ignition has not occurred by the times $t_2$ at which the pulses $S_2$ occur, then the spark logic 90 will create a spark occurrence at these times. Actually, when the slow speed decoder 123 determines that engine rotating speed is below a predetermined minimum level, the signal at the terminal 122 insures that dwell will be initiated at the times $t_1$ and that spark will occur at the times $t_2$. This provides a dwell equal to 35 degrees of crankshaft rotation for slow speed conditions and provides for spark ignition at essentially top dead center of the cylinder compression cycle. For engine speeds above this predetermined slow speed, the signal at the terminal 122 allows dwell to be initiated by the signal at the terminal 120 and spark to be determined by the zero detect provided at the terminal 94. The signal produced at the terminal 100 is initiated in response to when dwell is desired to commence ($t_{DW}$) and is terminated in response to when the spark logic 90 determines spark ignition should occur ($t_x$).

Figure 2:
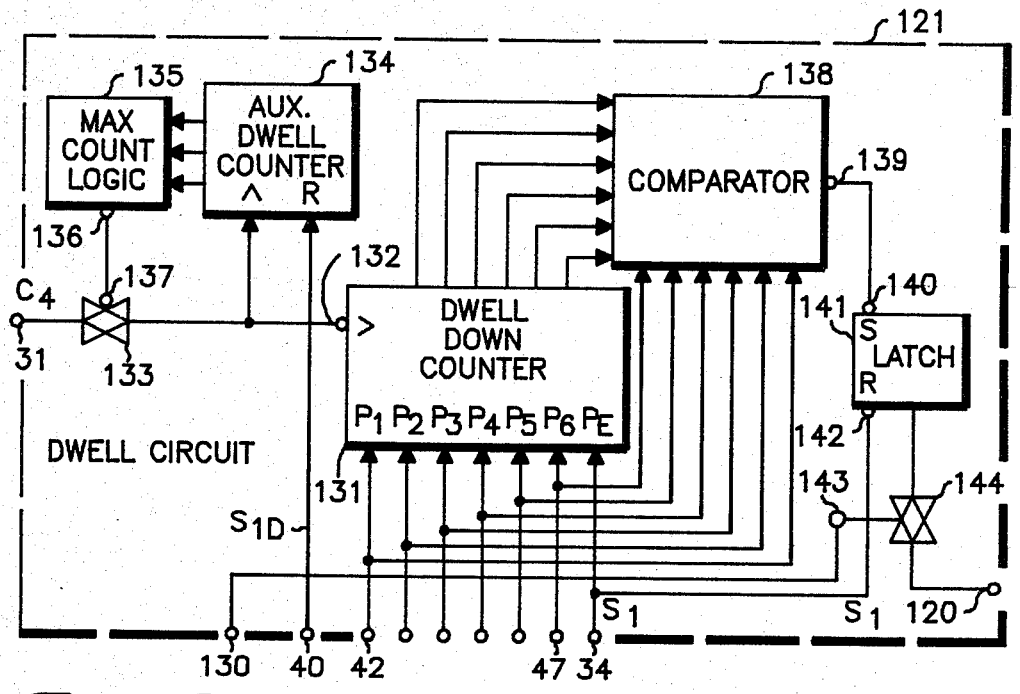
FIG. 2 is a schematic diagram illustrating a typical configuration for a dwell circuit illustrated in FIG. 1.
Figure 3:
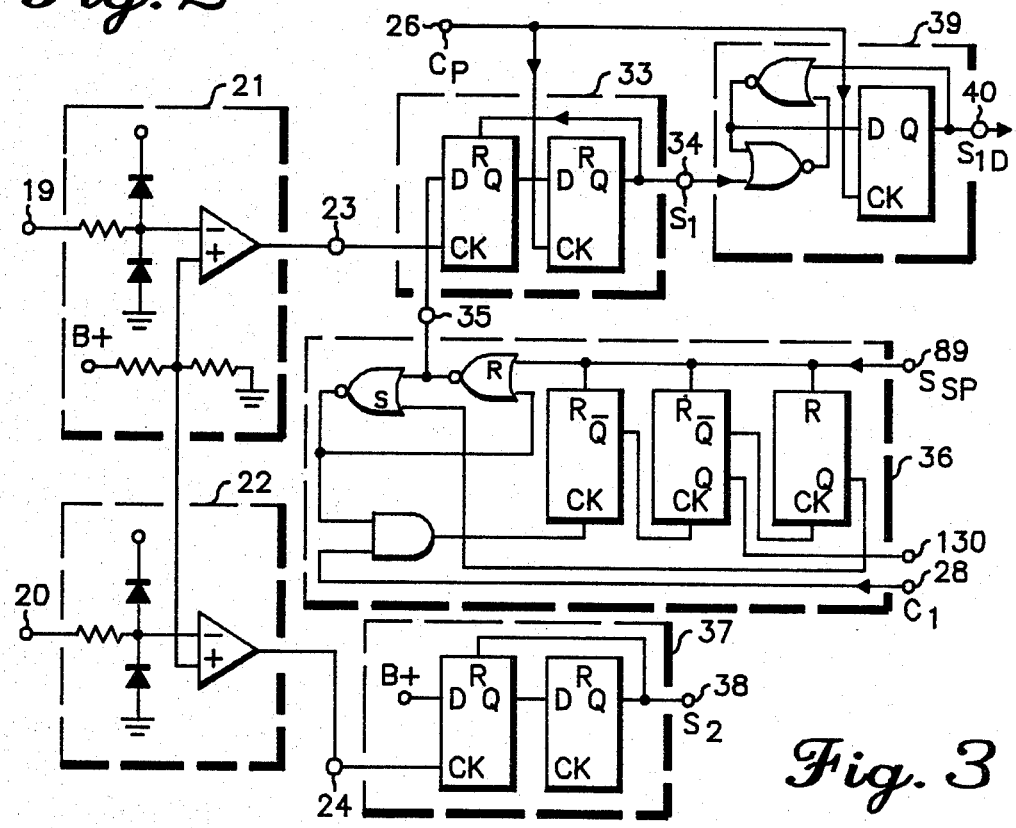
FIG. 3 is a schematic diagram illustrating typical circuit configurations for several of the block components shown in FIG. 1.

Typical embodiments for the dwell circuit 121 of the present invention will now be discussed. A first such typical embodiment 121 is illustrated in FIG. 2, and another embodiment 121' is illustrated in FIG. 4. The embodiment in FIG. 2 was previously developed by a co-worker of the present inventor and is claimed in copending U.S. patent application Ser. No. 049,013 filed June 15, 1979, now U.S. Pat. No. 4,329,959, entitled "Dwell Circuitry For An Ignition Control System" by Rupin Javeri, while the embodiment in FIG. 4 represents the present invention. In FIG. 4 prime notation is utilized to identify substantially similar corresponding components.

In both of the dwell embodiments shown in FIGS. 2 and 4, the dwell circuit 121 (121') receives running count counter inputs from the main counter output terminals 42 through 47 at preset input terminals $P_1$ through $P_6$ of a dwell down counter 131 (131'). The terminal 34 at which the $S_1$ pulses are produced is directly coupled to a preset enable terminal of the dwell down counter and a counting clock pulse input terminal 132 (132') for the dwell down counter is provided.

For the dwell circuit embodiment illustrated in FIG. 2, the terminal 31 at which the pulses $C_4$ are produced is coupled through a controllable gate 133 to the terminal 132. The terminal 132 is also coupled as a pulse counter input to an auxiliary dwell counter 134 which has a reset terminal directly coupled to the terminal 40 for receiving reset pulses at the times $t_1D$ corresponding to the pulses $S_1D$. The count output of the auxiliary dwell counter 134 is coupled to a maximum count logic circuit 135 which is intended to produce a low output signal at its output terminal 136 in response to the count in the auxiliary dwell counter reaching or exceeding a predetermined maximum count. The terminal 136 is directly connected to a control terminal 137 of the through gate 133. In this manner, the auxiliary dwell counter 134 insures that after the reception of reset pulses $S_1D$, the through gate 133 will pass a precise number of clock pulses as inputs to the input terminal 132 of the dwell down counter 131 and auxiliary counter 134.

At the times $t_1$, the count of the dwell counter 131 is preset to the maximum running count obtained by the main counter 41, wherein this maximum count is directly linearly related to engine crankshaft speed. The auxiliary dwell counter 134 and controllable gate 133 effectively result in, subsequently at times $t_1D$, having the dwell down counter 131 rapidly count down a predetermined number of counts from the maximum speed related count obtained by the main counter 41. It should be noted that the rate of down counting occurs at the relatively high repetition frequency of the signal $C_4$, whereas the rate of up counting the main counter 41 occurs at the substantially slower rate of occurrence of the pulses $C_1$. This results in the dwell down counter 131 effectively instantly subtracting (at times $t_1D$) the predetermined number of $C_4$ pulses passed through the controllable gate 133 from the maximum count which was pre-set into the dwell down counter 131 at the times $t_1$ by the synchronized pulses $S_1$.

For the dwell circuit in FIG. 2, the terminals 42 through 47 of the main up counter 41 are also coupled as inputs to a count comparator 138 which also receives the output count of the dwell down counter 131. When the count indicated by the terminals 42 through 47 equals or exceeds the count being held (after down counting has ceased) as the output count of the dwell down counter 131, the comparator 138 will produce a logic signal indicating this condition at an output terminal 139. The terminal 139 is coupled to an input set terminal 140 of a latch device 141. The output of the latch device 141 is coupled through a controllable gate 144 to the output terminal 120 of the dwell circuit 121 and a reset terminal 142 of the latch 141 is directly coupled to the terminal 34 at which the $S_1$ signal is produced. The two millisecond inhibit signal produced at the terminal 130 is coupled to a control terminal 143 of the controllable gate 144.

The dwell circuit shown in FIG. 2 operates as follows. At the time occurrence $t_1$ of the synchronized advance pulses $S_1$, the maximum running count in the main counter 41 is preset into the dwell down counter 131. At times $t_1D$ after the maximum count of the main counter 41 is loaded into the dwell down counter 131, the circuitry 132 through 137 has the down counter 131 rapidly count down a predetermined number of counts. Preferably this predetermined number of counts, which occurs by counting the high fixed frequency of the pulses $C_4$, will be equivalent to 6 milliseconds of real time as measured by an equivalent number of pulse counts at the frequency of the signal pulses $C_1$.

At the times $t_1D$ after the pre-setting of the dwell down counter 131, the main up counter 41 is reset by the pulses $S_1D$. At approximately this time the dwell down counter 131 will have completed its effective subtraction of a predetermined number of counts from the maximum count preset into the dwell down counter 131. Thus the comparator 138, just after the times $t_1D$, will compare the subtracted output count of the dwell down counter 131 with the newly initiated running count of the main up counter 41. Whenever the main up counter running count reaches or exceeds the held subtracted down count of the dwell counter 131, the comparator 138 will produce a high logic state at its output terminal 139 which will result in setting the latch 141 whose output at the terminal 120 signals the desired initiation of coil excitation (dwell). This mode of operation is essentially illustrated inn FIG. 5I wherein the vertical axis represents the count being stored in a counter and the horizontal axis represents time.

Essentially between first and second time occurrences $t_1D$ and $t_1$ (which directly correspond to identical polarity periodic signal pulse transitions of the variable rate occurrence signal $S_1$), the main counter 41 produces a running count by counting the pulses $C_1$ which have an engine speed independent repetition rate. At times $t_1$ a maximum running count related to engine crankshaft rotational speed is loaded into the down counter 131. The down counter then effectively subtracts a predetermined number of $C_4$ pulse counts to arrive at a resultant subtracted count at substantially the time occurrence $t_1$. This resultant subtracted count is then utilized to produce dwell ignition occurrences, preferably at a substantially fixed time duration prior to the next time occurrence to $t_1$ which corresponds to the next pulse transition of the periodic signal $S_1$.

It should be noted that while the present invention contemplates utilizing the crankshaft position sensor signal $S_1$ as the periodic signal having periodic signal pulse transitions occurring at a predetermined variable (speed dependent) rate, the present invention also contemplates the use of the spark occurrence signal SSp as the periodic signal having pulse transitions which occur at a variable (speed dependent) rate. In this manner the present invention can implement dwell at a predetermined time prior to spark ignition occurrence rather than at a predetermined time prior to the occurrence of a specific engine crankshaft position. In order to implement such a change only minor modifications of the disclosed circuitry are necessary and these modifications are within the capability of those of average skill in the art.

In FIG. 5I, the count of the dwell counter 131 is illustrated as a solid line whereas the count of the main up counter 41 is illustrated as a dashed line. FIG. 5I illustrates at the times $t_1$ a maximum count is preset into the dwell down counter 131 and then a predetermined number of counts is rapidly substracted (at times $t_1D$) from this number. Subsequently the dwell counter 131 maintains this subtracted count as its output. At the times $t_1D$, the count in the main counter 41 is set to zero and this counter will commence up counting in response to the pulses $C_1$ resulting in linear incrementing of the count of the counter 41. At a subsequent time $t_{DW}$ the count in the main counter 41 will equal the subtracted count being maintained by the dwell counter 131. At this time $t_{DW}$ the comparator 138 will produce a logic signal that will set the latch 141 and thereby signal the initiation of dwell by the signal produced at the latch output terminal 120. The latch 141 will be reset upon the occurrence of the pulse signal $S_1$.

The present invention, by utilizing substantially all of the time duration between identical polarity pulse transitions of the crankshaft position sensor signal $S_1$ to determine the maximum running count which is related to engine speed, has provided a maximum running count which is an extremely accurate indication of engine speed. Since this running count is updated for each engine crankshaft rotation of 360 degrees, the engine speed information is similarly updated for each crankshaft revolution thus providing an up to date indication of engine speed. By providing a maximum running count related to engine speed during one full cycle (between identical polarity transitions) of crankshaft revolution and utilizing this maximum running count to determine dwell initiation during the subsequent cycle of crankshaft revolution, the present invention is capable of producing large dwell angles which is something that has not been obtained by similar prior art circuits (U.S. Pat. No. 3,908,616) which illustrate utilizing a first portion of the crankshaft revolution cycle to calculate engine speed and a second portion of the same crankshaft revolution cycle to calculate dwell occurrence. Thus the prior art circuits limit dwell occurrence to this second portion of the crankshaft revolution cycle.

In addition to permitting the dwell circuit to implement large angles of dwell excitation, the present invention implements dwell without adjusting count threshold levels of count comparators and without adjusting the various rates of count accumulating. While adjusting the rate of count accumulating was found to be necessary for the spark control circuitry disclosed herein, it is obvious that the rate adjustment circuitry is much more complex and costly than the dwell control circuitry. Thus the present invention is believed to be superior to prior dwell control circuits which require adjusting pulse accumulation rates or pulse count switching threshold levels in order to implement a desired dwell excitation mode over a range of different engine speeds.

The controllable gate 144 is utilized to insure that the dwell initiating signal at terminal 120 will not start until at least 2 milliseconds after the occurrence of spark ignition. This insures that 100 percent dwell will not be obtained, and that therefore the primary ignition coil winding 104 will not be constantly excited. This insures the occurrence of a spark for each cylinder when it is in its compression cycle, since if the primary winding always received current excitation no spark could be generated.

FIG. 4 illustrates the dwell circuit embodiment 121' of the present invention which is similar to the embodiment shown in FIG. 2. Identical reference numbers are utilized for identical components and prime notation is used for similar components.

In FIG. 4, output count terminals 42 through 47 of the main counter 41 are connected to preset inputs $P_1$ through $P_6$ of a dwell down counter 131'. A preset enable terminal of the dwell counter 131' is directly coupled to the terminal 34 such that the counter will be preset in response to the pulses $S_1$. In FIG. 4, a dwell counter overflow terminal is directly connected to a terminal 139' which is coupled to a terminal 140' that is directly connected to the set terminal of a latch 141' having its output directly connected to the terminal 120 through a controllable gate 144'. A reset terminal of the latch 141' is directly connected to the terminal 34 thus providing for resetting the latch 141' in response to the signal $S_1$. The controllable gate 144' has a control terminal 143' which is directly connected to the terminal 130 such that the controllable gate 144' will implement a minimum 2 millisecond delay after SSp for initiating a dwell signal at terminal 120.

The dwell down counter 131' has a clock input terminal 132' which is coupled through a controllable gate 133' and an OR gate 160' to the terminal 31 at which the pulses $C_4$ are present. An auxiliary dwell counter 134' has a reset terminal directly connected to the terminal 40 and a clock signal input terminal directly connected to an output terminal 159 or gate 133'. The output count of the auxiliary dwell counter 134' is coupled to a maximum count logic circuit 135' which produces an output signal at a terminal 137' whenever the auxiliary dwell counter count equals or exceeds a predetermined count. The terminal 137' is directly connected as a control input terminal to the controllable gate 133', and this terminal is also coupled through an inverter stage to a control input terminal 150' of a controllable gate 151' coupled, together with OR gate 160', between the terminal 132' and the terminal 28 at which the pulses $C_1$ are present. The OR gate 160' permits pulses passed by either of the cotrollable gates 133' or 151' to reach the terminal 132'.

The operation of the dwell circuit 121' illustrated in FIG. 4 will now be described with reference to the graph shown in FIG. 5J which essentially illustrates the operation of the dwell circuit 121' by illustrating the count of the dwell down counter 131' as a function of time. At the times $t_1$, the dwell down counter 131' is preset with the maximum count obtained by the main up counter 41. At the subsequent times $t_1D$, the count of the auxiliary dwell counter 134' is set to zero resulting in the controllable gate 133' passing a predetermined number of the rapidly occurring clock pulses $C_4$. After the auxiliary dwell counter has counted this predetermined number of $C_4$ pulses, the maximum count logic circuit 135' will open the controllable gate 133' and result in closing the controllable gate 151'. During this time, the dwell down counter 131' has effectively, instantaneously subtracted this predetermined number of counts from the maximum count which was preset into the dwell counter 131'. Subsequent to this subtraction, the dwell down counter 131' will continue down counting at a rate determined by the occurrence of the pulses $C_1$. It should be noted that this occurrence rate is the same occurrence rate at which the main counter 41 is being linearly incremented up to its maximum count representative of engine crankshaft speed. At a subsequent time $t_{DW}$ the count in the dwell down counter 131' will reach zero and on the next count an overflow indication will be produced at the terminal 139'. This will result in setting the latch 141' and providing a dwell initiation signal at the output terminal 120 assuming at least a two millisecond delay between spark occurrence and dwell initiation.

The dwell circuit in FIG. 4 differs from that in FIG. 2 in that the need for a complex count comparator such as the comparator 138 in FIG. 2 is eliminated by the circuit configuration shown in FIG. 4. This is accomplished by having the dwell down counter 131 continue to count down at a rate determined by the $C_1$ pulses after effectively subtracting a predetermined number of counts occurring at the rapid frequency of the signal $C_4$. In this manner, the output of the dwell down counter 131' will reach zero at predetermined times $t_{DW}$ ahead of the predetermined times $t_1$. This occurs since if no counts were subtracted and engine speed remained the same, then the dwell down count would overflow exactly at times $t_1$. Thus the dwell circuits 121' and 121 insure that dwell initiation will occur at a predetermined time prior to the occurrence of the advance pulses $S_1$ at the times $t_1$. The circuit 121' in FIG. 4 accomplishes this end result without the use of the complex comparator 138 shown in FIG. 2 and therefore is believed to be more economical since fewer connecting lines and logic gates are required for the circuit 121'.

While I have shown and described several embodiments for the present invention, further improvements and modifications will occur to those of skill in the art. All such modifications which retain the basic underlying principles disclosed and claimed herein are within the scope of this invention.

I claim:

1. Improved digital circuitry for receiving a signal comprising periodic pulse transitions and producing indicative signals commencing at predetermined times prior to the occurrence of the periodic pulse transitions, said circuitry comprising:

means for producing a periodic signal comprising periodic signal pulse transitions occurring at a predetermined variable rate;

means for receiving said periodic signal and for periodically developing a running count by counting pulses occurring at a predetermined rate, independent of said variable rate, between first and second predetermined time occurrences directly corresponding to the occurrence of sequential first and second pulse transitions of said periodic signal, and for providing at said second time occurrences maximum running counts related to the time duration between said first and second pulse transitions;

means for periodically receiving said maximum counts and effectively subtracting a predetermined number of counts therefrom to obtain a resultant subtracted count, said subtraction being completed at substantially said second time occurrences; wherein the improvement comprises, means counting down from said resultant subtracted count at a rate which is independent of said variable rate; and means for periodically initiating an indicative signal when the down count from said resultant subtracted count equals a predetermined threshold count subsequent to said second time occurrence and at a predetermined time prior to the next of said periodic signal pulse transitions.

2. Improved digital circuitry according to claim 1 wherein said predetermined pulse rate for incrementing said running count is fixed.

3. Improved digital circuitry according to claim 1 wherein said down counting rate from said resultant subtracted count equals said running count rate.

4. Improved digital circuitry according to claim 3 wherein said subtraction means and said down counting means both include a commonly used down counter.

5. Improved digital circuitry according to claim 4 wherein said subtraction means includes means for loading said maximum running count into said down counter substantially at said second time occurrences and for subsequently applying a predetermined number of pulses to said down counter for down counting thereby, wherein said predetermined number of pulses has an occurrence rate substantially exceeding said rate of said pulses causing incrementing of said running count.

6. Improved digital circuitry according to claims 4 or 5 wherein said predetermined threshold count is a zero count of said down counter, and wherein said means for providing said indicative signal when said down count equals said predetermined threshold count includes a count overflow indication terminal of said down counter.

7. Improved digital circuitry according to claim 2 wherein said first, second and next periodic pulse transitions have the same polarity.

* * * * *